US007164391B2

(12) United States Patent
Lin et al.

(10) Patent No.: US 7,164,391 B2
(45) Date of Patent: Jan. 16, 2007

(54) ORIENTATION ADJUSTING DEVICE FOR A SATELLITE ANTENNA

(75) Inventors: Hung-Yuan Lin, Taipei Hsien (TW); San-Yi Kuo, Taipei Hsien (TW)

(73) Assignee: Wistron Neweb Corp., Taipei Hsien (TW)

( * ) Notice: Subject to any disclaimer, the term of this patent is extended or adjusted under 35 U.S.C. 154(b) by 14 days.

(21) Appl. No.: 11/170,231

(22) Filed: Jun. 28, 2005

(65) Prior Publication Data

US 2006/0181477 A1 Aug. 17, 2006

(30) Foreign Application Priority Data

Feb. 16, 2005 (TW) ..... 94104450 A

(51) Int. Cl.
*H01Q 3/02* (2006.01)

(52) U.S. Cl. ..... 343/882; 343/880; 343/892

(58) Field of Classification Search ..... 343/878, 343/880, 882, 892
See application file for complete search history.

(56) References Cited

U.S. PATENT DOCUMENTS 6,462,718 B1 * 10/2002 Ehrenberg et al. ..... 343/880
6,657,598 B1 * 12/2003 Tulloch ..... 343/765
6,963,316 B1 * 11/2005 Lin ..... 343/882
7,050,012 B1 * 5/2006 Chen ..... 343/757

* cited by examiner

*Primary Examiner*—Hoang V. Nguyen
(74) *Attorney, Agent, or Firm*—Ladas & Parry LLP

(57) ABSTRACT

An orientation adjusting device includes a base unit, a bracket unit, and an angle-adjusting mechanism. The bracket unit is coupled pivotally to the base unit. The angle-adjusting mechanism includes first and second rotatable units and first and second pivot joints. The first pivot joint interconnects the bracket unit and the first rotatable unit so as to permit rotation of the first rotatable unit relative to the bracket unit about a first horizontal axis. The second pivot joint interconnects the base unit and the second rotatable unit so as to permit rotation of the second rotatable unit relative to the base unit about a second horizontal axis parallel to the first horizontal axis. The telescopic unit interconnects the first and second rotatable units, and is operable so as to vary the distance between the first and second horizontal axes.

20 Claims, 5 Drawing Sheets

ORIENTATION ADJUSTING DEVICE FOR A SATELLITE ANTENNA

CROSS-REFERENCE TO RELATED APPLICATION

This application claims priority of Taiwanese application no. 094104450, filed on Feb. 16, 2005.

BACKGROUND OF THE INVENTION

1. Field of the Invention

This invention relates to an orientation adjusting device, and more particularly to an orientation adjusting device for a satellite antenna capable of fine tuning inclined and azimuth angles of the satellite antenna.

2. Description of the Related Art

A conventional satellite antenna orientation adjusting device includes a base unit, a bracket unit, and a pivot joint that interconnects the base unit and the bracket unit and that permits relative rotation between the base unit and the bracket unit. An antenna that includes a receiver is mounted on the bracket unit of the conventional orientation adjusting device.

In operation, when adjusting the orientation of the satellite antenna, the bracket unit is rotated at a desired angular position relative to the base unit. Thereafter, the bracket unit is fastened to the base unit with the use of screw fasteners so as to retain the bracket unit at the desired angular position.

The aforementioned conventional orientation adjusting device is disadvantageous in that the screw fasteners must be loosened and tightened each time the satellite antenna is reoriented. Such a process is inconvenient, time consuming, and prone to error.

SUMMARY OF THE INVENTION

Therefore, the object of the present invention is to provide an orientation adjusting device that is capable of overcoming the aforesaid drawback of the prior art.

According to one aspect of the present invention, an orientation adjusting device comprises a base unit, a bracket unit, and an angle-adjusting mechanism. The bracket unit is coupled pivotally to the base unit, and is pivotable in a vertical plane relative to the base unit. The angle-adjusting mechanism serves to adjust an angular position of the bracket unit relative to the base unit, and includes first and second rotatable units and first and second pivot joints. The first pivot joint interconnects the bracket unit and the first rotatable unit so as to permit rotation of the first rotatable unit relative to the bracket unit about a first horizontal axis. The second pivot joint interconnects the base unit and the second rotatable unit so as to permit rotation of the second rotatable unit relative to the base unit about a second horizontal axis parallel to the first horizontal axis. The telescopic unit interconnects the first and second rotatable units, and is operable so as to vary the distance between the first and second horizontal axes, thereby adjusting the angular position of the bracket unit relative to the base unit.

According to another aspect of the present invention, an orientation adjusting device comprises a base unit and an angle adjusting mechanism. The base unit includes first and second base members that are coupled pivotably to each other. The first base member is pivotable in a horizontal plane relative to the second base member. The angle-adjusting mechanism serves to adjust an angular position of the first base member relative to the second base member.

The angle-adjusting mechanism includes first and second rotatable units, first and second pivot members, and a telescopic unit. The first pivot member interconnects the first base member and the first rotatable unit so as to permit rotation of the first rotatable unit relative to the first base member about a first vertical axis. The second pivot member interconnects the second base member and the second rotatable unit so as to permit rotation of the second rotatable unit relative to the second base member about a second vertical axis parallel to the first vertical axis. The telescopic unit interconnects the first and second rotatable units, and is operable so as to vary the distance between the first and second vertical axes, thereby adjusting the angular position of the first base member relative to the second base member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
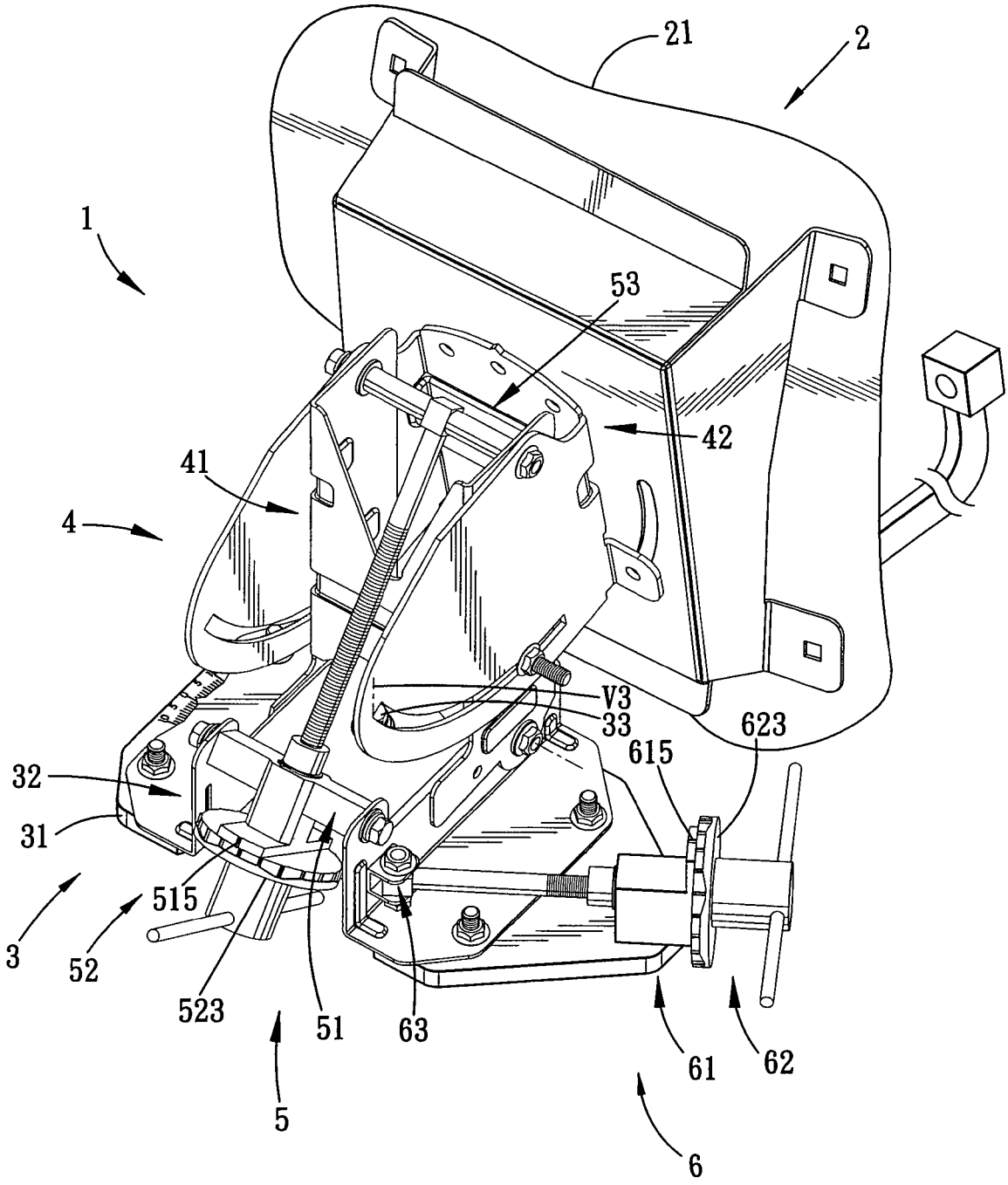
FIG. 1 is a perspective view of the first preferred embodiment of an orientation adjusting device of an apparatus according to the present invention.

Before the present invention is described in greater detail, it should be noted that like elements are denoted by the same reference numerals throughout the disclosure.

Figure 2:
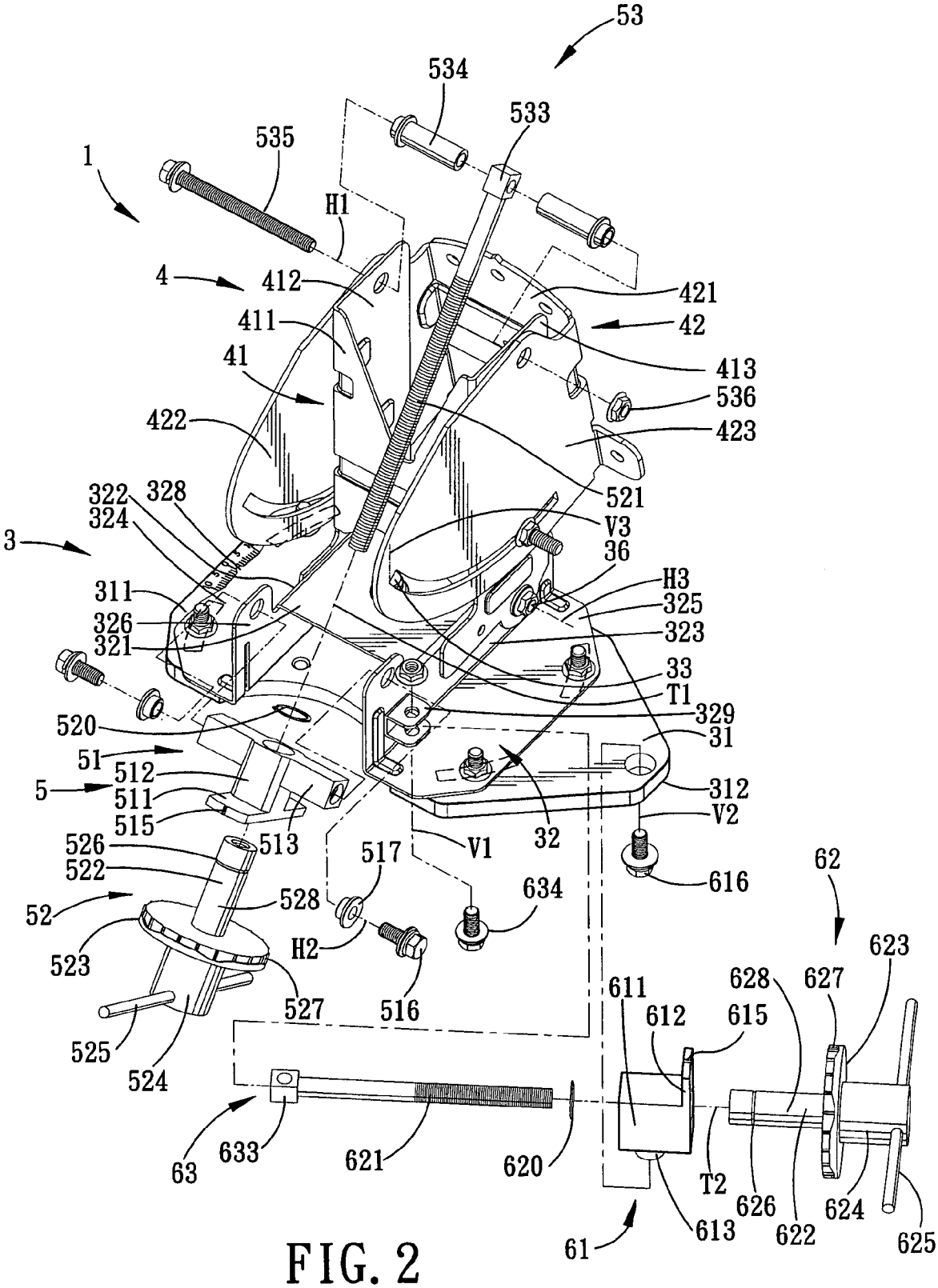
FIG. 2 is an exploded perspective view of the first preferred embodiment.

Referring to FIGS. 1 and 2, the first preferred embodiment of an orientation adjusting device of an apparatus 1 according to the present invention is shown to include a base unit 3, a bracket unit 4, and first and second angle-adjusting mechanisms 5, 6.

The apparatus 1 includes an antenna 2, such as a satellite antenna, mounted on the orientation adjusting device. Typically, the antenna 2 includes a receiver 21 that receives a satellite signal. Since the antenna 2 is not pertinent to the present invention, a detailed description thereof is omitted herein for the sake of brevity. The orientation adjusting device of this embodiment serves to adjust the orientation of the receiver 21 of the antenna 2 in a manner that will be described hereinafter.

The base unit 3 includes a first base member 32 that includes a pair of parallel left and right vertical plates 322, 323, an intermediate horizontal plate 321 that interconnects the left and right vertical plates 322, 323 of the first base member 32 of the base unit 3, and a pair of left and right horizontal plates 324, 325, each of which extends outwardly from a respective one of the left and right vertical plates 322, 323 of the first base member 32 of the base unit 3.

The bracket unit 4 is coupled pivotally to the base unit 3, and includes a first bracket member 41 that, in turn, includes a pair of parallel left and right plates 412, 413, each of which has upper and lower end portions, and an interconnecting plate 411 interconnecting the upper end portions of the left and right plates 412, 413 of the first bracket member 41 of the bracket unit 4.

The first angle-adjusting mechanism 5 serves to adjust an angular position of the bracket unit 4 relative to the base unit 3 in a vertical plane. In this embodiment, the first angle-adjusting mechanism 5 includes first and second rotatable units 53, 51, a first pivot joint 535, a pair of second pivot joints 516, and a first telescopic unit 52.

The first pivot joint 535 interconnects the upper end portions of the left and right plates 412, 413 of the first bracket member 41 of the bracket unit 4, and the first rotatable unit 53 of the first angle-adjusting mechanism 5 so as to permit rotation of the first rotatable unit 53 of the first angle-adjusting mechanism 5 relative to the first bracket member 41 of the bracket unit 4 about a first horizontal axis (H1).

In this embodiment, the first rotatable unit 53 of the first angle-adjusting mechanism 5 includes a hole-defining piece 533 and a pair of tubular members 534. The hole-defining piece 533 of the first rotatable unit 52 of the first angle-adjusting mechanism 5 is sleeved rotatably on the first pivot joint 535, and has opposite ends. Each of the tubular members 534 of the first rotatable unit 53 of the first angle-adjusting mechanism 5 is sleeved on the first pivot joint 535, and is disposed between a respective one of the left and right plates 412, 413 of the first bracket member 41 of the bracket unit and a respective one of the ends of the hole-defining piece 533 of the first rotatable unit 53 of the first angle-adjusting mechanism 5.

Each of the second pivot joints 516 interconnects the respective one of the left and right vertical plates 322, 323 of the first base member 32 of the base unit 3, and the second rotatable unit 51 of the first angle-adjusting mechanism 5 so as to permit rotation of the second rotatable unit 51 of the first angle-adjusting mechanism 5 relative to the first base member 32 of the base unit 3 about a second horizontal axis (H2) parallel to the first horizontal axis (H1).

It is noted that each of the second pivot joints 516 has an enlarged head, and a threaded shank that extends from the enlarged head.

In this embodiment, the second rotatable unit 51 of the first angle-adjusting mechanism 5 includes a first tubular member 513 that is disposed between the left and right vertical plates 322, 323 of the first base member 32 of the base unit 3, and that has opposite ends, each of which is sleeved on the threaded shank of a respective one of the second pivot joints 516.

The orientation adjusting device further includes a pair of inserts 517, each of which is sleeved on the threaded shank of the respective one of the second pivot joints 516, and is disposed between the enlarged head of a respective one of the second pivot joints 516 and a respective one of the left and right vertical plates 322, 323 of the first base member 32 of the base unit 3.

The orientation adjusting device further includes a first pivot bolt 36 that interconnects the left and right vertical plates 322, 323 of the first base member 32 of the base unit 3 and the lower end portions of the left and right plates 412, 413 of the first bracket member 41 of the bracket unit 4 so as to permit rotation of the bracket unit 4 relative to the base unit 3 about a third horizontal axis (H3) parallel to the first and second horizontal axes (H1, H2).

The bracket unit 4 further includes a second bracket member 42 that is generally U-shaped, and includes a pair of parallel left and right plates 422, 423, and an interconnecting plate 421 that interconnects the left and right plates 422, 423 of the second bracket member 42 of the bracket unit 4. The antenna 2 is mounted on the interconnecting plate 421 of the second bracket member 42 of the bracket unit 4.

The first pivot joint 535 interconnects the upper end portions of the left and right plates 412, 413 of the first bracket member 41 and the left and right plates 422, 423 of the second bracket member 42 so as to permit rotation of the second bracket member 42 relative to the first bracket member 41 about the first horizontal axis (H1).

It is noted that the first pivot joint 535 is retained on the bracket unit 4 with the use of a nut 536 in a known manner.

The first telescopic unit 52 interconnects the hole-defining piece 533 of the first rotatable unit 53 of the first angle-adjusting mechanism 5, and the first tubular member 513 of the second rotatable unit 51 of the first angle-adjusting mechanism 5, and is operable so as to vary the distance between the first and second horizontal axes (H1, H2). Therefore, the first telescopic unit 52 is able to adjust the angular position of the bracket unit 4 relative to the base unit 3 in the vertical plane.

In this embodiment, the first telescopic unit 52 includes first and second telescopic members 521, 522. The first telescopic member 521 of the first telescopic unit 52 has a connecting end portion that is connected securely to the hole-defining piece 533 of the first rotatable unit 53 of the first angle-adjusting mechanism 5, and a threaded end portion that is opposite to the connecting end portion and that is formed with an outer thread. The second telescopic member 522 of the first telescopic unit 52 is coupled rotatably to the second rotatable unit 51 of the first angle-adjusting mechanism 5, and is further coupled threadedly to the threaded end portion of the first telescopic member 521 of the first telescopic unit 52. In particular, the second rotatable unit 51 of the first angle-adjusting mechanism 5 further includes a second tubular member 512 that is connected securely and transversely to the first tubular member 513 of the second rotatable unit 51 of the first angle-adjusting mechanism 5, and that has an end provided with an abutting flange 511. The second telescopic member 522 of the first telescopic unit 52 has an actuating end portion 524 that is provided with a radially extending flange 523 abutting against the flange 511 of the second tubular member 512 of the second rotatable unit 51 of the first angle-adjusting mechanism 5, and a threaded end portion 528 that is opposite to the actuating end portion 524, that is formed with an inner thread (not shown), that is inserted rotatably through the second tubular member 512 of the second rotatable unit 51 of the first angle-adjusting mechanism 5, and that is threadedly coupled to the threaded end portion of the first telescopic member 521 of the first telescopic unit 52. The second telescopic member 522 of the first telescopic unit 52 is rotatable relative to the second tubular member 512 of the second rotatable unit 51 of the first angle-adjusting mechanism 5 about a first transverse axis (T1) transverse to the first and second horizontal axes (H1, H2).

The threaded end portion 528 of the second telescopic member 522 of the first telescopic unit 52 is formed with an outer annular groove 526. A C-clamp 520 is fitted into the annular groove 526 so as to retain the second telescopic member 522 of the first telescopic unit 52 in the second tubular member 512 of the second rotatable unit 51 of the first angle-adjusting mechanism 5.

It is noted that the interconnecting plate 411 of the first bracket member 41 of the bracket unit 4 is formed with a V-shaped groove through which the first telescopic unit 52 extends for interconnecting the first and second rotatable units 53, 51 of the first angle-adjusting mechanism 5.

The first telescopic unit 52 further includes an operable member 525 that extends transversely through the actuating end portion 524 of the second telescopic member 522 of the first telescopic unit 52, and that is operable so as to drive rotation of the second telescopic member 522 of the first telescopic unit 52 to result in axial displacement of the first telescopic member 521 of the first telescopic unit 52 along the first transverse axis (T1) to thereby vary the distance between the first and second horizontal axes (H1, H2).

Figure 3:
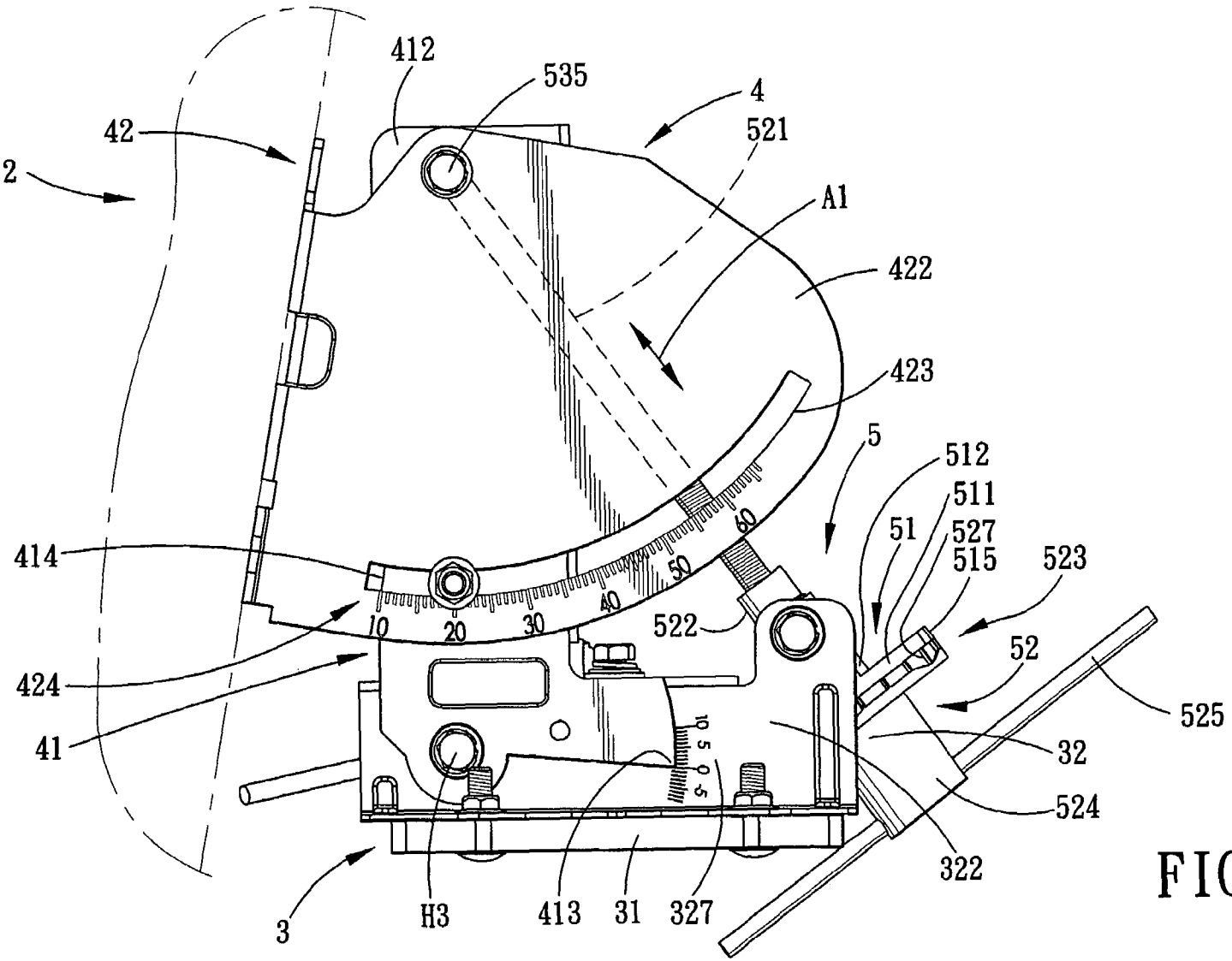
FIG. 3 is a schematic view illustrating a first angle-adjusting mechanism of the preferred embodiment.

It is noted that, as best shown in FIG. 3, the left plate 422 of the second bracket member 42 of the bracket unit 4 is formed with a curved window 423 therethrough, and is marked with graduations 424 adjacent to the window 423. The upper end portion of the left plate 412 of the first bracket member 41 of the bracket unit 4 is provided with a pointer 414 that is registered with the window 423. The graduations 424 and the pointer 414 cooperatively form an angle indicator for indicating angular position of the second bracket member 42 relative to the first bracket member 41. Moreover, the left vertical plate 322 of the first base member 32 of the base unit 3 is marked with graduations 327. The lower end portion of the left plate 412 of the first bracket member 41 of the bracket unit 4 is provided with a pointer 413. The graduations 327 and the pointer 413 cooperatively form an angle indicator for indicating the angular position of the first bracket member 41 of the bracket unit 4 relative to the first base member 32 of the base unit 3. Further, the flange 523 of the actuating end portion 524 of the second telescopic member 522 of the first telescopic unit 52 has a periphery that is marked with graduations 527. The flange 511 of the second tubular member 512 of the second rotatable unit 51 of the first angle-adjusting mechanism 5 is provided with a pointer 515. The graduations 527 and the pointer 515 cooperatively form an angle indicator for indicating the angular position of the second telescopic member 522 of the first telescopic unit 52 relative to the second tubular member 512 of the second rotatable unit 51 of the first angle-adjusting mechanism 5.

The orientation adjusting device further includes a second angle-adjusting mechanism 6 that serves to adjust the angular position of the first base member 32 relative to the second base member 31 in a horizontal plane. In this embodiment, the second angle-adjusting mechanism 6 includes first and second rotatable units 63, 61, first and second pivot members 634, 616, and a second telescopic unit 62.

The right vertical plate 323 of the first base member 32 of the base unit 3 is provided with a pair of parallel ears 329.

The first pivot member 634 interconnects the ears 329 of the right vertical plate 323 of the first base member 32 of the base unit 3, and the first rotatable unit 63 of the second angle-adjusting mechanism 6 so as to permit rotation of the first rotatable unit 63 of the second angle-adjusting mechanism 6 relative to the right vertical plate 323 of the first base member 32 of the base unit 3 about a first vertical axis (V1).

In this embodiment, the first rotatable unit 63 of the second angle-adjusting mechanism 6 includes a hole-defining piece 633 that is disposed between the ears 329 of the right vertical plate 323 of the first base member 32 of the base unit 3 and that is sleeved on the first pivot member 634.

The second pivot member 616 interconnects the right end portion 312 of the second base member 31 of the base unit 3, and the second rotatable unit 61 of the second angle-adjusting mechanism 6 so as to permit rotation of the second rotatable unit 61 of the second angle-adjusting mechanism 6 relative to the second base member 31 of the base unit 3 about a second vertical axis (V2) parallel to the first vertical axis (V1).

The base unit 3 further includes a second base member 31 that has left and right end portions 311, 312, and an intermediate portion (not shown) interconnecting the left and right end portions 311, 312 of the second base member 31. The first base member 32 is disposed on the second base member 31.

The orientation adjusting device further includes a second pivot bolt 33 that interconnects the intermediate horizontal plate 321 of the first base member 32 and the intermediate portion of the second base member 31 so as to permit rotation of the first base member 32 relative to the second base member 31 about a third vertical axis (V3) parallel to the first and second vertical axes (V1, V2). The second pivot bolt 33 is retained on the base unit with the use of a nut in a known manner.

Figure 4:
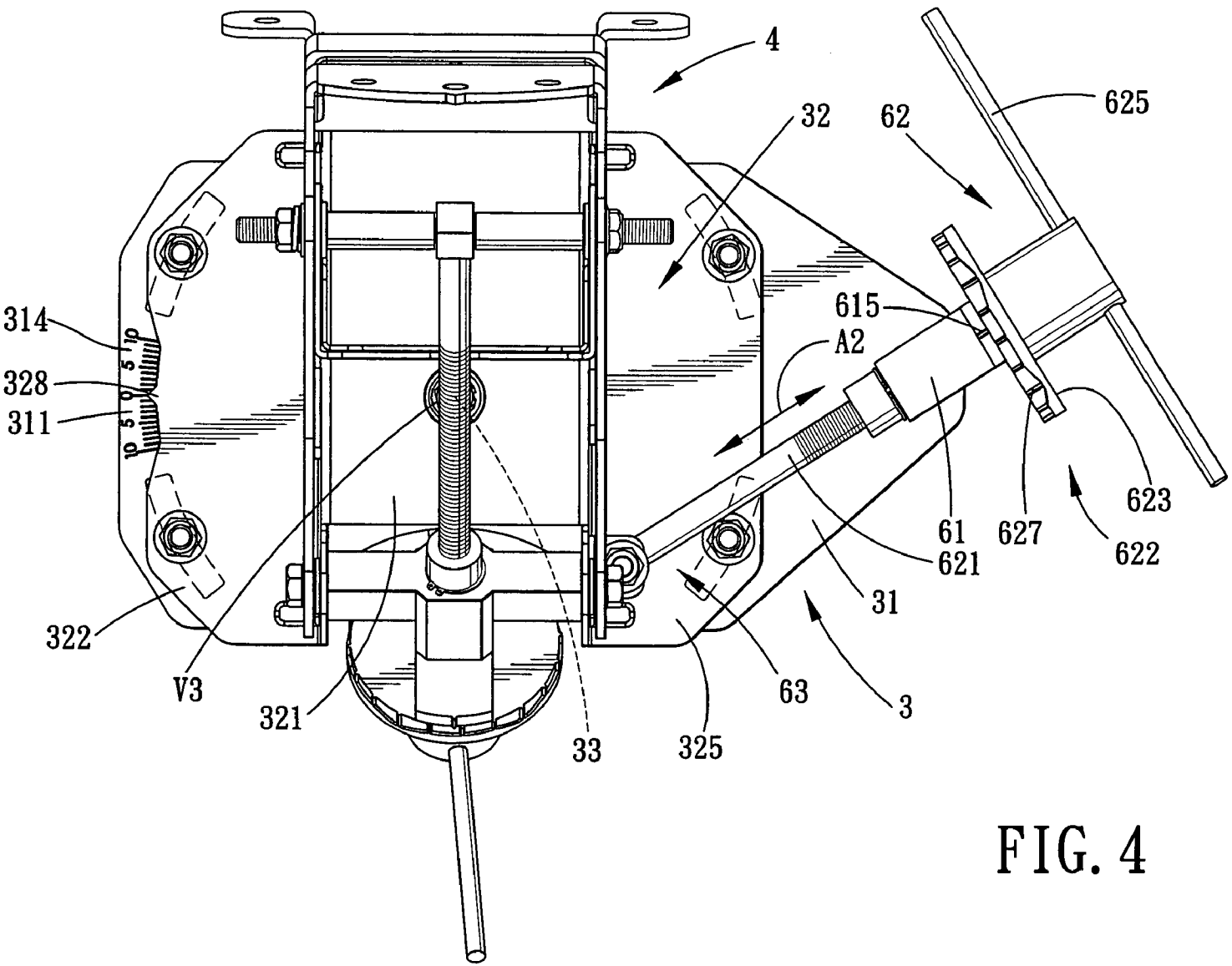
FIG. 4 is a schematic view illustrating a second angle-adjusting mechanism of the preferred embodiment.

It is noted that, as best shown in FIG. 4, the left end portion 311 of the second base member 31 of the base unit 3 is marked with graduations 314. The left horizontal plate 322 of the first base member 32 of the base unit 3 is provided with a pointer 328. The graduations 314 and the pointer 328 cooperatively form an angle indicator for indicating the angular position of the first base member 32 relative to the second base member 31.

In this embodiment, the second rotatable unit 61 of the second angle-adjusting mechanism 6 includes a first tubular member 611 that has an end provided with a flange 612, and a second tubular member 613 that extends downwardly from the first tubular member 611 of the second rotatable unit 61 of the second angle-adjusting mechanism 6 and that is sleeved rotatably on the second pivot member 616.

The second telescopic unit 62 interconnects the third and second rotatable units 63, 61 of the second angle-adjusting mechanism 6, and is operable so as to vary the distance between the first and second vertical axes (V1, V2). Therefore, the second telescopic unit 62 is able to adjust the angular position of the first base member 32 relative to the second base member 31 in the horizontal plane.

In this embodiment, the second telescopic unit 62 includes first and second telescopic members 621, 622. The first telescopic member 621 of the second telescopic unit 62 has a connecting end portion that is connected securely to the hole-defining piece 633 of the first rotatable unit 63 of the second angle-adjusting mechanism 6, and a threaded end portion that is formed with an outer thread. The second telescopic member 622 of the second telescopic unit 62 is coupled rotatably to the second rotatable unit 61 of the second angle-adjusting mechanism 6. In particular, the second telescopic member 622 of the second telescopic unit 62 has an actuating end portion 624 that is provided with a radially extending flange 623 abutting against the flange 615 of the first tubular member 611 of the second rotatable unit 61 of the second angle-adjusting mechanism 6, and a threaded end portion 628 that is opposite to the actuating end portion 624 of the second telescopic member 622 of the second telescopic unit 62, that is formed with an inner thread (not shown), that is inserted rotatably through the first tubular member 611 of the second rotatable unit 61 of the second angle-adjusting mechanism 6, and that is threadedly coupled to the threaded end portion of the first telescopic member 621 of the second telescopic unit 62. The second telescopic member 622 of the second telescopic unit 62 is rotatable relative to the first tubular member 611 of the second rotatable unit 61 of the second angle-adjusting mechanism 6 about a second transverse axis (T2) transverse to the first and second vertical axes (V1, V2).

The threaded end portion 626 of the second telescopic member 622 of the second telescopic unit 62 is formed with an outer annular groove 626. A C-clamp 620 is fitted into the annular groove 626 so as to retain the second telescopic member 622 of the second telescopic unit 62 in the first tubular member 611 of the second rotatable unit 61 of the second angle-adjusting mechanism 6.

It is noted that, as best shown in FIG. 2, the flange 623 on the actuating end portion 624 of the second telescopic member 622 of the second telescopic unit 62 has a periphery that is marked with graduations 627. The flange 612 of the first tubular member 611 of the second rotatable unit 61 of the second angle-adjusting mechanism 6 is provided with a pointer 615. The graduations 627 and the pointer 615 cooperatively form an angle indicator for indicating the angular position of the second telescopic member 622 of the second telescopic unit 62 relative to the first tubular member 611 of the second rotatable unit 61 of the second angle-adjusting mechanism 6.

The second telescopic unit 62 further includes an operable member 625 that extends transversely through the actuating end portion 624 of the second telescopic member 622 of the second telescopic unit 62, and that is operable so as to drive rotation of the second telescopic member 622 of the second telescopic unit 62 to result in axial displacement of the first telescopic member 621 of the second telescopic unit 62 along the second transverse axis (T2) to thereby vary the distance between the first and second vertical axes (V1, V2).

In operation, as illustrated in FIG. 3, when adjusting the inclined angle of the antenna 2, the second bracket member 42 may be first rotated to a desired angular position relative to the first bracket member 41. Subsequently, the operable member 525 of the first telescopic unit 52 is operated so as to drive rotation of the second telescopic member 522 of the first telescopic unit 52. The rotation of the second telescopic member 522 of the first telescopic unit 52 results in the axial displacement, as indicated by arrow (A1), of the first telescopic member 521 of the first telescopic unit 52 along the first transverse axis (T1) (see FIG. 2), which, in turn, adjusts the angular position of the bracket unit 2 relative to the base unit 1 in the vertical plane. Furthermore, as illustrated in FIG. 4, when adjusting the azimuth angle of the antenna 2, the first base member 32 may be first rotated to a desired angular position relative to the second base member 31. Subsequently, the operable member 625 of the second telescopic unit 62 is operated to drive rotation of second telescopic member 622 of the second telescopic unit 62. The rotation of the second telescopic member 622 of the second telescopic unit 62 results in the axial displacement, as indicated by arrow (A2) of the first telescopic member 621 of the second telescopic unit 62 along the second transverse axis (T2) (see FIG. 2), which, in turn, adjusts the angular position of the first base member 32 relative to the second base member 31 in the horizontal plane.

Figure 5:
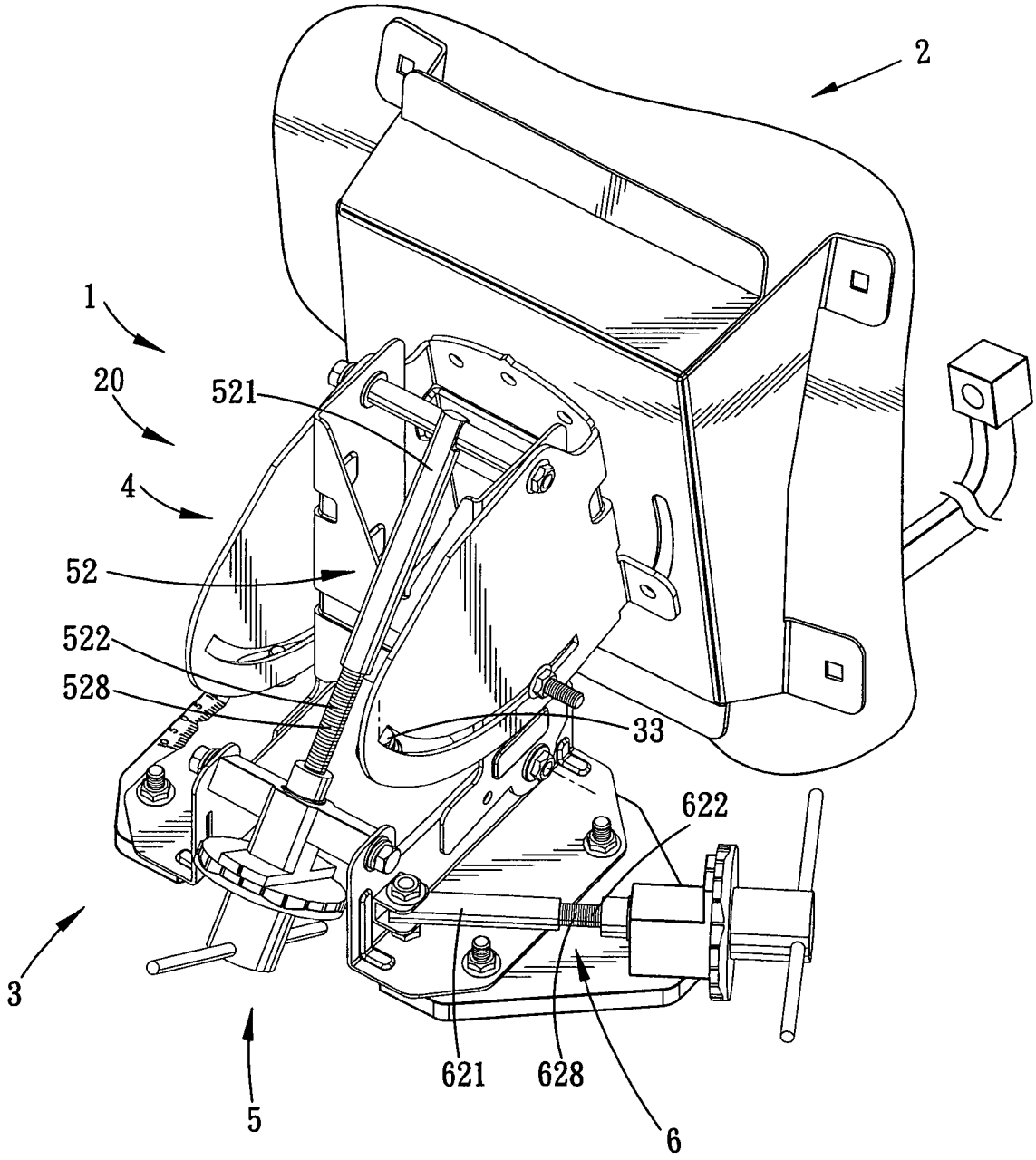
FIG. 5 is a perspective view of the second preferred embodiment of an orientation adjusting device of an apparatus according to the present invention.

FIG. 5 illustrates the second preferred embodiment of an orientation adjusting device of an apparatus 1 according to the present invention. When compared with the previous embodiment, the threaded end portion of the first telescopic member 521 of the first telescopic unit 52 is formed with an inner thread, whereas the threaded end portion 528 of the second telescopic member 522 of the first telescopic unit 52 is formed with an outer thread. Furthermore, the threaded end portion of the first telescopic member 621 of the second telescopic unit 62 is formed with an inner thread, whereas the threaded end portion 628 of the second telescopic member 622 of the first telescopic unit 62 is formed with an outer thread.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. An orientation adjusting device, comprising:

a base unit;

a bracket unit coupled pivotally to said base unit, said bracket unit being pivotable in a vertical plane relative to said base unit; and an angle-adjusting mechanism for adjusting an angular position of said bracket unit relative to said base unit, said angle-adjusting mechanism including a first rotatable unit, a first pivot joint that interconnects said bracket unit and said first rotatable unit so as to permit rotation of said first rotatable unit relative to said bracket unit about a first horizontal axis, a second rotatable unit, at least one second pivot joint that interconnects said base unit and said second rotatable unit so as to permit rotation of said second rotatable unit relative to said base unit about a second horizontal axis parallel to the first horizontal axis, and a telescopic unit that interconnects said first and second rotatable units, and that is operable so as to vary the distance between the first and second horizontal axes, thereby adjusting the angular position of said bracket unit relative to said base unit.

2. The orientation adjusting device as claimed in claim 1, wherein said telescopic unit includes a first telescopic member that is connected to said first rotatable unit, and a second telescopic member that is coupled rotatably to said second rotatable unit and that is coupled threadedly to said first telescopic member of said telescopic unit, said second telescopic member of said telescopic unit being rotatable relative to said second rotatable unit about a transverse axis transverse to the first and second horizontal axes, wherein rotation of said second telescopic member of said telescopic unit about the transverse axis results in axial displacement of said first telescopic member of said telescopic unit along the transverse axis.

3. The orientation adjusting device as claimed in claim 2, wherein said second rotatable unit includes a first tubular member that is sleeved rotatably on said second pivot unit, and a second tubular member that is connected securely and transversely to said first tubular member, said second telescopic member of said telescopic unit having an actuating end portion that is formed with a radially extending flange abutting against said second tubular member of said second rotatable unit, and a threaded end portion that is opposite to said actuating end portion, that is inserted rotatably through said second tubular member of said second rotatable unit, and that is coupled threadedly to said first telescopic member of said telescopic unit.

4. The orientation adjusting device as claimed in claim 3, wherein said threaded end portion of said second telescopic member of said telescopic unit is formed with an outer annular groove, said orientation adjusting device further comprising a clamp fitted into said annular groove so as to retain said second telescopic member in said second tubular member of said second rotatable unit.

5. The orientation adjusting device as claimed in claim 3, wherein said telescopic unit further includes an operable member that is coupled securely to said actuating end portion of said second telescopic member of said telescopic unit, and that is operable so as to drive rotation of said second telescopic member of said telescopic unit relative to said second tubular member of said second rotatable unit.

6. The orientation adjusting device as claimed in claim 3, comprising a pair of said second pivot joints, said first tubular member of said second rotatable unit having opposite ends, each of which threadedly engages a respective one of said second pivot joints.

7. The orientation adjusting device as claimed in claim 6, further comprising a pair of inserts, each of which is sleeved on a respective one of said second pivot joints.

8. The orientation adjusting device as claimed in claim 2, further comprising an angle indicator for indicating an angular position of said second telescopic member of said telescopic unit relative to said second rotatable unit, said angle indicator including graduations marked on said second telescopic member of said telescopic unit, and a pointer provided on said second rotatable unit.

9. The orientation adjusting device as claimed in claim 2, wherein said first telescopic member of said telescopic unit is formed with an outer thread, and said second telescopic member of said telescopic unit is formed with an inner thread.

10. The orientation adjusting device as claimed in claim 2, wherein said first telescopic member of said telescopic unit is formed with an inner thread, and said second telescopic member of said telescopic unit is formed with an outer thread.

11. An orientation adjusting device, comprising:

a base unit including first and second base members that are coupled pivotably to each other, said first base member being pivotable in a horizontal plane relative to said second base member; and an angle-adjusting mechanism for adjusting an angular position of said first base member relative to said second base member, said angle-adjusting mechanism including a first rotatable unit, a first pivot member that interconnects said first base member and said first rotatable unit so as to permit rotation of said first rotatable unit relative to said first base member about a first vertical axis, a second rotatable unit, a second pivot member that interconnects said second base member and said second rotatable unit so as to permit rotation of said second rotatable unit relative to said second base member about a second vertical axis parallel to the first vertical axis, and a telescopic unit that interconnects said first and second rotatable units, and that is operable so as to vary the distance between the first and second vertical axes, thereby adjusting the angular position of said first base member relative to said second base member.

12. The orientation adjusting device as claimed in claim 11, wherein said telescopic unit includes a first telescopic member that is connected to said first rotatable unit, and a second telescopic member that is coupled rotatably to said second rotatable unit and that is coupled threadedly to said first telescopic member of said telescopic unit, said second telescopic member of said telescopic unit being rotatable relative to said second rotatable unit about a transverse axis transverse to the first and second vertical axes, wherein rotation of said second telescopic member of said telescopic unit about the transverse axis results in axial displacement of said first telescopic member of said telescopic unit along the transverse axis.

13. The orientation adjusting device as claimed in claim 12, wherein said second rotatable unit includes a first tubular member, and a second tubular member that extends downwardly from said first tubular member and that is sleeved rotatably on said second pivot member, said second telescopic member of said telescopic unit having an actuating end portion that is formed with a radially extending flange abutting against said second tubular member of said second rotatable unit, and a threaded end portion that is opposite to said actuating end portion, that is inserted rotatably through said first tubular member of said second rotatable unit, and that is coupled threadedly to said first telescopic member of said telescopic unit.

14. The orientation adjusting device as claimed in claim 13, wherein said threaded end portion of said second telescopic member of said telescopic unit is formed with an outer annular groove, said orientation adjusting device further comprising a clamp fitted into said annular groove so as to retain said second telescopic member in said second tubular member of said second rotatable unit.

15. The orientation adjusting device as claimed in claim 13, wherein said telescopic unit further includes an operable member that is coupled securely to said actuating end portion of said second telescopic member of said telescopic unit, and that is operable so as to drive rotation of said second telescopic member of said telescopic unit relative to said second tubular member of said second rotatable unit.

16. The orientation adjusting device as claimed in claim 12, further comprising an angle indicator for indicating an angular position of said second telescopic member of said telescopic unit relative to said second rotatable unit, said angle indicator including graduations marked on said second telescopic member of said telescopic unit, and a pointer provided on said second rotatable unit.

17. The orientation adjusting device as claimed in claim 12, wherein said first telescopic member of said telescopic unit is formed with an outer thread, and said second telescopic member of said telescopic unit is formed with an inner thread.

18. The orientation adjusting device as claimed in claim 12, wherein said first telescopic member of said telescopic unit is formed with an inner thread, and said second telescopic member of said telescopic unit is formed with an outer thread.

19. An apparatus, comprising:

an orientation adjusting device including a base unit, a bracket unit coupled pivotally to said base unit, said bracket unit being pivotable in a vertical plane relative to said base unit, and an angle-adjusting mechanism for adjusting an angular position of said bracket unit relative to said base unit, said angle-adjusting mechanism including a first rotatable unit, a first pivot joint that interconnects said bracket unit and said first rotatable unit so as to permit rotation of said first rotatable unit relative to said bracket unit about a first horizontal axis, a second rotatable unit, at least one second pivot joint that interconnects said base unit and said second rotatable unit so as to permit rotation of said second rotatable unit relative to said base unit about a second horizontal axis parallel to the first horizontal axis, and a telescopic unit that interconnects said first and second rotatable units, and that is operable so as to vary the distance between the first and second horizontal axes, thereby adjusting the angular position of said bracket unit relative to said base unit; and an antenna mounted on said bracket unit of said orientation adjusting device.

20. An apparatus, comprising:

an orientation adjusting device including a base unit including first and second base members that are coupled pivotably to each other, said first base member being pivotable in a horizontal plane relative to said second base member, and an angle-adjusting mechanism for adjusting an angular position of said first base member relative to said second base member, said angle-adjusting mechanism including a first rotatable unit, a first pivot member that interconnects said first base member and said first rotatable unit so as to permit rotation of said first rotatable unit relative to first base member about a first vertical axis, a second rotatable unit, a second pivot member that interconnects second base member and said second rotatable unit so as to permit rotation of said second rotatable unit relative to said second base member about a second vertical axis parallel to the first vertical axis, and a telescopic unit that interconnects said first and second rotatable units, and that is operable so as to vary the distance between the first and second vertical axes, thereby adjusting the angular position of said first base member relative to said second base member; and an antenna mounted on said first base member of said base unit of said orientation adjusting device.

* * * * *